United States Patent [19]

Kurrasch

[11] Patent Number: 5,009,043

[45] Date of Patent: Apr. 23, 1991

[54] ACOUSTIC PANEL

[75] Inventor: Andrew J. Kurrasch, Saugatuck, Mich.

[73] Assignee: Herman Miller, Inc., Zeeland, Mich.

[21] Appl. No.: 551,916

[22] Filed: Jul. 12, 1990

[51] Int. Cl.[5] ..... E04B 1/82; E04B 1/84

[52] U.S. Cl. ..... 52/145; 52/144; 52/239; 181/290; 181/291; 181/294

[58] Field of Search ..... 52/145, 239, 144; 181/290, 291, 294

[56] References Cited

U.S. PATENT DOCUMENTS

| | | | |
|---|---|---|---|
| 2,730,772 | 1/1956 | Jones . | |
| 2,990,027 | 6/1961 | Sabine . | |
| 3,769,767 | 11/1973 | Scott . | |
| 3,858,676 | 1/1975 | Le Masurier . | |
| 3,948,346 | 4/1976 | Schindler . | |
| 4,057,123 | 11/1977 | Erickson . | |
| 4,205,110 | 5/1980 | Jean | 428/213 |
| 4,248,647 | 2/1981 | Herron et al. . | |
| 4,480,715 | 11/1984 | Brooks . | |
| 4,571,906 | 2/1986 | Ashton . | |
| 4,759,964 | 7/1988 | Fischer | 428/116 |
| 4,935,281 | 6/1990 | Tolbert | 428/116 |

*Primary Examiner*—Richard E. Chilcot, Jr.
*Assistant Examiner*—Robert Canfield
*Attorney, Agent, or Firm*—Varnum, Riddering, Schmidt & Howlett

[57] ABSTRACT

An acoustic panel having highly desirable sound absorption characteristics. The panel is preferably formed of an open frame, there being at least one septum centrally located within the frame opening and in contact with the frame members. On each side of the septum are expanded fiberglass batts. Both sides of the frame are faced with perforated hardboard sheets which, in turn, are covered by an open-cell foam layer and a layer of scrim material comprising metal foil and a tear-resistant backing. The panels can be covered with a decorative fascia such as fabric or synthetic sheet materials.

22 Claims, 1 Drawing Sheet

ACOUSTIC PANEL

BACKGROUND OF THE INVENTION

1. Field of the Invention

This invention relates in general to new and useful improvements in panels which may be utilized as modular office partitions and, more particularly, to an acoustic panel having desirable sound absorbing characteristics and which has fire-retardant qualities.

2. Description of the Related Art

Office space is often rented as a large open area generally without partitions. Normally such office space is divided into a number of smaller, more functional work stations, rooms and halls by utilizing semi-permanent panels of varying height in the form of metal frames joined together at their edges and having covered cores.

Movement of people through and around the work stations, rooms and hallways, conversations, telephone conferences, normal operation of office equipment, and business activities in general can generate considerable noise. The noise can be distracting to workers and visitors to the office and can diminish work place productivity. Accordingly, there is considerable need for panels that have the capacity to absorb sound and frustrate the transmission of sound therethrough. It is also desirable that these panels be fire resistant or retardant in order to meet local fire codes.

A number of attempts to make acoustic and fire-retardant panels have been made heretofore. Most of these panels have been relatively expensive.

Webster U.S. Pat. No. 4,441,580, issued Apr. 10, 1984, discloses an acoustical panel having air impervious septum, a layer of low-density fiberglass, a perforated layer of medium-density fibrous board having tackable qualities and an outer layer of fiberglass or decorative fabric. A steel rim surrounds the panel. Structured rigidity must be provided by the septum and the steel rim. This construction has relatively low torsional resistance.

The U.S. Pat. No. to Lapins et al. 4,630,416, issued Dec. 23, 1986, discloses a sound-absorbing acoustical panel which consists of a central honeycomb core that acts like a septum. On both sides of the honeycomb core a thin facing sheet of aluminum has holes placed in the skin forming Helmholtz resonators with the honeycomb core. The holes alternate between columns of the honeycomb cells which are open on only one side. Attached to the skins is a layer of porous sound-absorbing material, which consists of a thin layer of high density fiberglass and an outer layer of variable density fiberglass. The outer layer is of variable density fiberglass, from low density to more dense as it approaches the thin high-density layer. The decorative fabric layer covers a porous soundabsorbing layer. The sound-absorbing panel is enclosed in a frame of channel shape rails which presumably are made of metal. The Helmholtz resonators are difficult to tune to a broad range of frequencies and work best for narrow frequency bands. The panels require precise manufacturing tolerances and procedures.

The U.S. Pat. Nos. to Sailor et al. 4,084,366, issued Apr. 18, 1978, Sailor et al. 3,084,367, issued Apr. 18, 1978 and Sailor et al. 4,155,211, issued May 22, 1979, all disclose an acoustical panel similar to the Lapins et al. '416 panel.

The U.S. Pat. No. to Haugen et al. 4,702,046 issued Oct. 27, 1987, discloses an acoustical wall panel that mounts to a wall with a frame. The acoustical wall panel consists of a wooden frame that encloses fiberglass batts. Attached to the back of the frame is a plastic covering and in front of the frame is a rigid acoustical tectum board. An acoustical transparent cloth wraps around the wooden frame and is stapled thereto to cover the acoustical board. The Haugen et al. wall panel does not have the structural integrity required for partitions nor does it have the required sound barrier properties required for partition applications.

Herman Miller, Applicant's assignee, has heretofore manufactured and sold an office panel having a particle board frame, a honeycomb core, a hardboard layer covering the honeycomb board and attached to the frame, a scrim layer covering the hardboard layer and a decorative fabric covering the scrim layer. The scrim layer is a combination of a thin aluminum foil backed by a very thin layer of fibrous batting such as fiberglass. This prior panel has fire-resistant characteristics but did not have acoustical properties. The particle board frame is directional in nature. The pressed surfaces of the frame face outwardly and inwardly of the framing material so that the fabric can be attached to the outer surface through staples.

Herman Miller, Applicant's assignee, has also heretofore manufactured an acoustical panel in which clear pine rails and stiles form a frame, a hardboard septum is mounted within the frame, fiberglass batting is mounted within the frame on each side of the septum and a perforated steel panel was nailed or stapled to the frame. A layer of half-inch fiberglass batting is positioned outside the steel panels. A decorative fabric layer covers the fiberglass layer and is stapled to the outside edges of the frame. The clear pine frame elements were required to hold the nails or staples used to secure the steel panel to the frame as well as to hold staples used to hold the fabric to the sides of the frame members. The panels had a slightly puffy appearance.

The U.S. Pat. No. to Ashton, 4,571,906, issued Feb. 25, 1986, discloses a sectional screen in which a wood frame has a septum in a central portion, fiberglass batting in cells formed within the frames, a perforated wall on each side of the frame and a sound-absorbing cloth covering the frame.

SUMMARY OF THE INVENTION

This invention relates to a sound-absorbing panel which may be readily utilized as a partition member in a freestanding, open plan office system and which comprises an open, rectangular frame having a sound transmission blocking septum mounted therein. Fiberglass batting is provided adjacent the septum. Each side of the frame is finished in a similar manner including a perforated hardboard facing sheet that is adhesively bonded to the frame. A layer of open-cell foam is carried by the facing sheets and a foil layer is applied over the foam layer. Finally, the panel is finished on each side with a decorative fascia such as vinyl or fabric material. The foil layer preferably has a thin layer of fiberglass or vermiculite backing for fire retardancy.

More particularly, it has been found that the combination of the open-cell foam and the foil layer in combination with the perforated hardboard, fiberglass batting and septum provides for excellent sound absorbing characteristics. The foil layer provides a fire protective barrier through which sound energy may be transmitted to be absorbed by the fiberglass batting.

The frame can be divided into cells by frame members which extend between the stiles of the frame for increased rigidity.

Further, the frame is preferably formed of pressed particle board which has the pressed surfaces facing outwardly and inwardly of the frame. The foil and fabric layers are affixed to the particle board frame, preferably through staples or similar mechanical fasteners which are driven into the outer sides of the frame.

With the above and other objects in view that will hereinafter appear, the nature of the invention will be more clearly understood by reference to the following detailed description, the appended claims, and the several views illustrated in the accompanying drawings.

BRIEF DESCRIPTION OF THE DRAWINGS

The invent now be described with reference to the drawings in which.

DETAILED DESCRIPTION OF THE PREFERRED EMBODIMENTS

Figure 2:
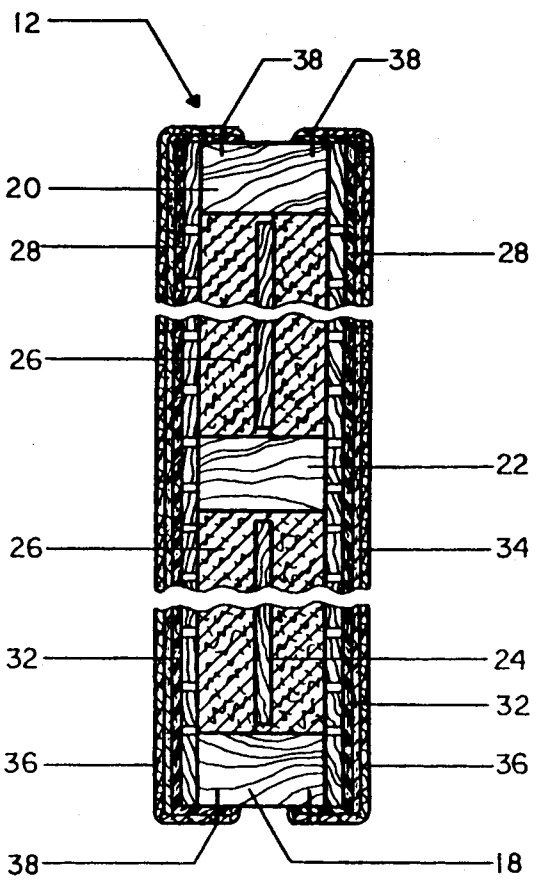
FIG. 2 a vertical sectional view of the acoustic panel of FIG. 1, with intermediate vertical portions thereof omitted for clarity.
Figure 1:
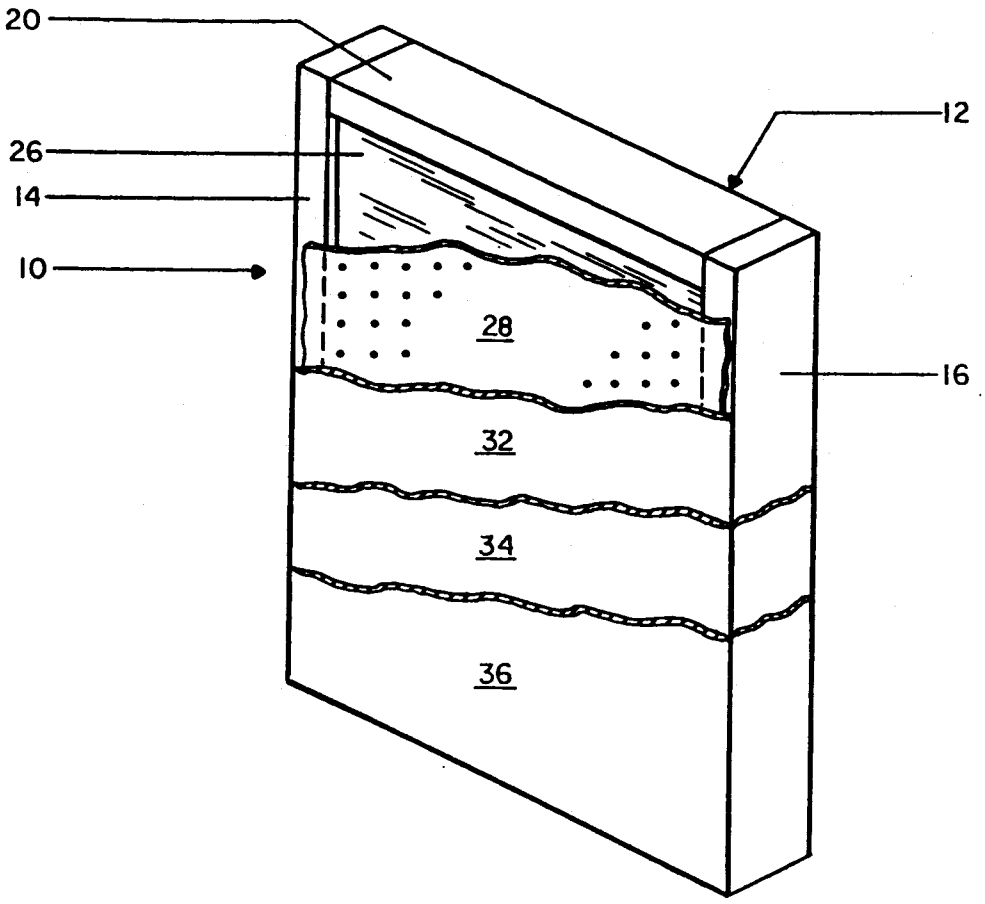
FIG. 1 a partially broken away elevational view of an acoustic panel formed in accordance with the invention.

Referring now to the drawings, an acoustic panel formed in accordance with the invention is identified generally by the reference numeral 10. The panel 10 is adapted for use as a wall panel or partition in a modular office furniture system of the open plan type wherein the panel, in conjunction with other panels of like construction, subdivide an otherwise large open area into smaller, more functional work spaces. The panels 10 are typically finished with connectors and slotted rails at the sides and glides at the bottom.

The panel 10 includes a frame generally identified by the reference numeral 12. The frame 12 is formed of vertical stiles 14, 16 and horizontal rails 18, 20 connected together to provide a generally open, rectangular structure. If desired, the frame 12 may be reinforced by horizontal bracing members 22, as best shown in FIG. 2. Further, while no vertical reinforcing members have been illustrated, these may be included as well. The various frame members 14, 16, 18 and 20 are preferably formed of 1¾" hardboard, wood particle board, or other compressed wood fiber composite material. The pressed surfaces face outwardly (and inwardly) so that they can receive mechanical fasteners such as staples. The rails 18 and 20 can be secured together by any suitable fastening technique, such as staples or adhesive bonding. The pressed particle board frames are relatively inexpensive compared to clear wood frames or metal framing.

Mounted within the open portion of the frame 12 and centered with respect thereto are a pair of septums 24. The septums 24 tightly fit within the frame 12 and are suitably secured thereto such as by way of adhesive or appropriate mechanical fasteners. The septums are preferably formed of ⅛" hardboard. Thus, it will be seen that the frame 12 and the septums 24 define a plurality of cells 25. Each cell 25 is filled with a ¾" batt 26 of insulation. The insulation is preferably of an expanded fiberglass construction having a density on the order of 1 lb/ft$^3$ although other sound absorbing filler materials such as heavy felt, mineral wool, expanded plastic foams and the like can be used. The insulation density can vary over a wide range so long as it has good sound absorption qualities. Fiberglass batting with densities of at least 0.6 lb/ft$^3$ and up to 4 lb/ft$^3$ can be used in the cells for insulation purposes.

The frame 12 is covered with a facing layer 28 on each side thereof. Each facing layer 28 is preferably in the form of a perforated, rigid hardboard sheet preferably having a thickness of approximately ⅛". The perforations 29 in each facing layer 28 are approximately 0.5" in diameter on approximately 1.0" centers. The perforations 29 provide approximately 20% open space relative to the total surface area of the respective facing layer 28. The facing layer 28 is secured to opposite sides or faces of the frame 12 by cold pressing utilizing a suitable adhesive (not shown in the drawings). The perforated hardboard layer 28 and the frame 12 give suitable structural rigidity to the panel for office partitions to which furniture components can be hung.

The facing layer 28 is a low-cost structural member which permits passage of sound waves therethrough. The thickness of the board can vary but is preferably in the range of ⅛" to ⅜". The size and spacing of holes as well as the percent open space in the facing layer 28 can vary so long as the layer has sufficient rigidity and strength to meet structural requirements of the panel and so long as there are sufficient openings for adequate sound passage into the sound absorbing cells. Thus, the size of the holes can vary between 0.25–0.75 inches and the spacing of the holes can vary so that the open space comprises generally from 15–30% of the total surface area of the facing layer 28.

Each facing layer 28 is, in turn, overlaid with a layer 32 of open-cell foam which has a thickness of approximately 0.06". An example of a suitable foam is available from Kent Manufacturing Co. of Grand Rapids, Mich., under their product number 7R27. The foam serves as a spacing layer and can be made of different materials with different degrees of porosity, different thicknesses and different densities. The foam layer is preferably formed of polyester having a density of approximately 1.2 lb/ft$^3$ and a thickness of 0.06 inches, although other open-cell foams of even lesser thickness may be suitable so long as the spacing function is performed.

A scrim layer 34 overlies each foam layer 32. The scrim layer 34 is preferably formed of a thin layer of metal, for example aluminum, foil having a tear-resistant fiberglass or vermiculite backing layer laminated thereto. Suitable scrim materials can be obtained from Lydell, Inc. of Troy, N.Y. 12181 or Springs Industries, Inc. of Fort Mill, S.C. 29715. The thin aluminum foil layer is mounted against the foam layer to give vapor impermeability to the panel. The thin fiberglass or vermiculite layer gives fire retardancy to the panel. The thickness of the scrim layer is typically in the range of 2–25 thousands of an inch, although 5 thousands of an inch is preferable.

The scrim layer 34 is significant in that it provides a fire protective barrier yet allows sound energy to be transmitted therethrough to be absorbed by the fiberglass batting 26. The foil layer is impermeable to gases and thus prevents passage of combustible gases which might be generated from the wood frame, septum and facing layer 28 from passing through the fabric layers to a flame source. The fiberglass backing on the scrim layer 34 provides a measure of heat insulation for the foil layer. The foam layer 32, in combination with the scrim layer 34 provides superior and synergistic sound-absorbing capabilities for the hardboard/fiberglass and septum panel. The scrim layer 34 can be secured to the frame 12 by a variety of well-known mechanical fasteners or can be adhesively bonded. Alternatively, the scrim layer 34 can be "unsecured" in that it is not directly mounted to the frame 12 but held in place by a fabric or fascia layer.

The panel 10 can be finished by the addition of a decorative fascia layer 36 such as a suitable fabric or synthetic sheet material such as vinyl which preferably is selected so as to blend aesthetically with the surrounding environment. The decorative fascia layers 36 are preferably secured directly to the outside faces of the frame 12 in any desired manner such as through the use of stables, brads, tacks, nails or adhesive bonding.

Desirably, the scrim layer 34 and the decorative fascia layer 36 are mechanically fastened to the outer surfaces of the stiles 14, 16 and the rails 18, 20 through staples 38. It is also possible, although not preferable, to glue the scrim layer 34 and the decorative fabric layer 36 to the outer surfaces of the stiles and rails. The particle board is anisotropic in nail-receiving capabilities. The pressed surfaces retain nails well whereas the side surfaces do not. The invention provides for the pressed surfaces to be at the outer (and inner) sides of the frame to receive staples to quickly and easily secure the scrim and fabric layers to the frame outer surfaces. The stapling of the fabric and scrim layer to the outer surfaces of the frame is a technique which most favors a smooth fabric surface at the edges of the panel. The worker can stretch the fabric on the frame and quickly staple the fabric in place. Other fabric fastening techniques, such as groove and welt cord, are more difficult, more time-consuming and do not always result in smooth fabric at the corners of the panel.

EXAMPLE 1

An acoustic panel formed in accordance with the invention was tested for sound absorption in accordance with ASTM Designation C423-84 using the overall area of the two face sides of a 48"×79¼" panel. The test panel had 0.06" thick chipboard center septa, ¾" thick 1.0 pcf fiberglass, 0.125" thick hardboard (⅜" diameter holes on 1" centers) with 20% open area covered with 0.06 Kent 7R27 open-cell foam and a layer of #1151 foil-scrim material, upholstered with open-weave fabric. The panel was freestanding with a negligible gap at the floor. The following test results were observed:

| Frequency (Hz) | 125 | 250 | 500 | 1000 | 2000 | 4000 | N.R.C.* |
|---|---|---|---|---|---|---|---|
| Sound Absorption Coefficient | .16 | .32 | .73 | .91 | .81 | .50 | .70 |
| Sound Absorption in Sabins/ Unit Area | 8.5 | 16.9 | 38.5 | 47.8 | 42.9 | 26.3 | |

*Noise reduction coefficient.

The results show that suitable noise-reduction coefficients over a broad frequency range were achieved. A sound transmission test (ASTM E90-87) conducted on this panel showed a sound transmission class of 23.

EXAMPLE 2

An identical panel as in Example 1, except for the foam layer 32, was tested in the same fashion as the panel of Example 1 was tested. the following results were observed:

| Frequency (Hz) | 125 | 250 | 500 | 1000 | 2000 | 4000 | N.R.C.* |
|---|---|---|---|---|---|---|---|
| Sound Absorption Coefficient | .10 | .28 | .64 | .87 | .59 | .46 | .60 |
| Sound Absorption in Sabins/ Unit Area | 5.3 | 15.0 | 33.6 | 46.1 | 31.3 | 24.4 | |

*Noise reduction coefficient.

A standard sound transmission test (ASTM E90-87) showed a sound transmission class of 22. This panel showed significantly lower sound absorption and slightly less sound transmission characteristics than the panel of Example 1.

The results of the tests on the two panels show that the use of an open-cell foam layer between the perforated hardboard and the scrim layer unexpectedly improves both sound absorption and sound transmission properties.

Reasonable variation and modification are possible with the foregoing disclosure and drawings without departing from the spirit and scope of the invention as defined by the appended claims.

The embodiments for which an exclusive property or privilege is claimed are defined as follows:

1. In an acoustic wall panel comprising a peripheral frame having opposed sides and defining an opening, a septum mounted in said opening to restrict sound transmission therethrough, an inner sound-absorbing filling received within said opening, a rigid perforated facing secured to each side of said peripheral frame to permit sound to pass therethrough and to rigidify said frame, and an outer decorative fascia secured to said frame, the improvement which comprises:

a sound-transmitting spacer layer overlying each facing and a thin gas impervious foil layer overlying said sound-transmitting spacer layer layer to provide fire retardancy to said panel.

2. An acoustic wall panel according to claim 1 wherein said perforated facings are each formed of hardboard.

3. An acoustic wall panel according to claim 1 wherein said perforated facings are each formed of hardboard with perforations being on the order of 0.25–0.75 inch in diameter.

4. An acoustic wall panel according to claim 3 wherein said perforated facings are each formed of hardboard having an open area in the range of 15–30%.

5. An acoustic wall panel according to claim 1 wherein said perforated facings are each formed of hardboard having an open area in the range of 15–30%.

6. An acoustic wall panel according to claim 1 wherein said inner filling is formed of an expanded fiberglass.

7. An acoustic wall panel according to claim 1 wherein said inner filling is formed of an expanded fiberglass having a density on the order of at least 0.6 $lb/ft^3$.

8. An acoustic wall panel according to claim 1 wherein said septum tightly engages said frame.

9. An acoustic wall panel according to claim 1 wherein said septum tightly engages said frame and is formed of solid hardboard.

10. An acoustic wall panel according to claim 1 wherein said sound-transmitting spacer layer comprises a thin foam layer.

11. An acoustic wall panel according to claim 10 wherein said foam layer is an open-cell foam.

12. An acoustic wall panel according to claim 10 wherein said foam layer is an open-cell foam having a thickness on the order of 0.06 inch.

13. An acoustic wall panel according to claim 10 wherein said foam layer is an open-cell foam having a density on the order of 1.2 $lb/ft^3$.

14. Ah acoustic wall panel according to claim 10 wherein said foil layer includes an aluminum foil layer with a coating selected from fiberglass and vermiculite.

15. An acoustic wall panel according to claim 14 wherein said aluminum foil layer is in facing contact with said foam layer.

16. An acoustic wall panel according to claim 1 wherein said frame is formed of pressed particle board.

17. An acoustic wall panel according to claim 16 wherein said particle board members have pressed surfaces which face outwardly and said decorative fascia and at least one of said fascia and foil layers is mechanically fastened to said outwardly facing pressed surfaces of said frame.

18. An acoustic wall panel according to claim 1 wherein said foil layer has a thickness in the range of 2 to 25 thousands of an inch.

19. An acoustic wall panel comprising a peripheral frame, sound absorbing means and soundtransmission reduction means within said frame, and an outer decorative fascia, the improvement which comprises a thin foam layer and a metal foil layer between said foam layer and said decorative fascia.

20. An acoustic wall panel according to claim 19 wherein said foam layer is an open-cell foam having a density on the order of 1.2 $lb/ft^3$.

21. An acoustic wall panel according to claim 20 wherein said foil layer includes an aluminum foil layer with a coating selected from fiberglass and vermiculite, said coating being adjacent said fascia.

22. An acoustic wall panel according to claim 21 wherein said foil layer has a thickness in the range of 2 to 25 thousands of an inch.

* * * * *